United States Patent [19]

Dutro

[11] 3,934,754

[45] Jan. 27, 1976

[54] DEVICE FOR ISSUING SINGLE UNITS OF FLAT FLEXIBLE ARTICLES

[76] Inventor: Lyle V. Dutro, 1908 Meadowbrook, Altadena, Calif. 91001

[22] Filed: Jan. 28, 1974

[21] Appl. No.: 436,834

[52] U.S. Cl. ..... 221/213; 271/18.3; 271/118

[51] Int. Cl.[2] ..... B65H 3/22

[58] Field of Search ..... 221/210, 213, 214, 215, 221/216, 217, 166, 240; 194/2; 271/95, 118, 120, 18.3

[56] References Cited

UNITED STATES PATENTS

| | | | |
|---|---|---|---|
| 1,345,855 | 7/1920 | Hotaling | 221/214 X |
| 2,546,352 | 3/1951 | Weaver | 221/17 |
| 2,564,879 | 8/1951 | Cook | 221/215 |
| 2,926,814 | 3/1960 | Utiger | 221/213 |
| 3,095,998 | 7/1963 | Kienel | 221/213 |
| 3,127,167 | 3/1964 | Rabinow et al. | 271/95 |
| 3,251,448 | 5/1966 | Kienel | 221/213 X |

*Primary Examiner*—Robert B. Reeves
*Assistant Examiner*—Joseph J. Rolla
*Attorney, Agent, or Firm*—Donald D. Mon

[57] ABSTRACT

A device for issuing single copies of flat flexible articles, such as newspapers or magazines. A stripper member comprising a rotatable conveyor has engagement elements which engage an article to be issued near one of the edges of the article. The conveyor is rotated while traversing the face of the article, carrying the edge with it so as to wrap the article upon the conveyor's periphery until the article is stripped (peeled) from the stack. The article is then released and discharged through an exit orifice. The device may be coin-controlled, so as to issue an article only after the necessary coins have been provided, either by permitting the stripper member to be moved with an engaged article only when proper coins have been inserted, or by permitting the engagement elements to engage the article only when a coin has been inserted. The device may be provided with a holder to display one of the articles and issue it as the last article, after the other inventory has been issued.

44 Claims, 11 Drawing Figures

DEVICE FOR ISSUING SINGLE UNITS OF FLAT FLEXIBLE ARTICLES

CROSS-REFERENCE TO OTHER PATENT APPLICATION

This is a continuation of U.S. patent application Ser. No. 295,128, filed Oct. 5, 1972, entitled "Device for Issuing Single Units of Flat Flexible Articles", now abandoned.

This invention relates to a device for issuing single copies of flat flexible articles, such as newspapers or magazines.

The problem of selling single copies of newspapers and magazines at retail has been a particularly nagging one. Even when a newsstand is under full-time supervision, shoplifting is a problem, particularly of more expensive magazines. Of course most newstands cannot economically be operated 24 hours per day, and therefore are not. Single copy sales devices, such as are commonly found along the sidewalks and used for unsupervised dispensing of copies, have the inherent problem that the entire stack is exposed each time a single coin is presented to the machine. Such machines rely upon the honesty of the individual, and the assumption is that he will take no more than one copy. While this may be true for low cost items, such as weekday newspapers (although surveys have shown this to be far from true), distributors have been most reluctant to take the risk with magazines, whose retail value and cost to them are very much higher than of newspapers, and which represent a considerably greater temptation to the thief. Accordingly, potential sales of the more expensive articles are lost because they cannot be sold in unattended places (and even in attended places theft is an important economic drain), and shoplifting of the less expensive articles sold in known machines is a significant economic loss.

It is an object of this invention to provide a device which can issue single copies of newspapers, magazines or other flat flexible articles, one at a time, in response to the proper number of coins. It is a further object of this invention to provide this objective in a simple and rugged device which is proof against tampering, and which can be made relatively inexpensively.

It is another object of this invention to provide such a device wherein no article in the inventory, much less the entire inventory is ever made directly available to the operator of the machine. The single copy purchased and paid for is issued through a sidewall of the machine only after the proper sum has been paid, and it is issued without giving access to the inventory.

It is another object of this invention to provide a device wherein even the most vigorous activation, or attempted activation, by a potential user cannot cause spurious actuation of the device itself.

It is an optional objective of this invention to provide a device wherein the last copy in the inventory is visible to the user to assure him that there is a copy to be purchased, this display copy being issued last, after the remainder of the inventory has been exhausted.

A device according to this invention includes a stripper member upon which an article to be dispensed can be wrapped. The stripper member has an axis of rotation and is mounted for rotation around this axis. It is also mounted for lateral translation relative to this axis. Support means supports articles in the inventory in a stack adjacent to the path of the stripper member.

Engagement means is carried by the stripper member, which engagement means can engage the article to be dispensed near an edge thereof so as releasably to hold the article to the periphery of the stripper member as the stripper member is rolled along adjacent to the surface of the article to be dispensed while traversing the face of the article. This motion will strip (in the sense of "peel") an article from the stack, and, after the article is brought up over the top of the stripper member, it will be released through a slot in the wall of the vending machine.

According to an optional feature of the invention, extension means is provided to move the engagement means to an extended position, where it will engage an article to be issued, as a consequence of the receipt of coins totaling a predetermined sum.

According to another optional feature of the invention, transmission means is provided between the stripper member and a source of power which decouples the source of power from the stripper means in the absence of coins totaling the predetermined amount.

According to yet another optional feature of the invention, a last, display, copy in the inventory is held in a display slot so it can be seen by a purchaser in order that he will know there is a copy available to him if he deposits his money. Means is provided to release this display copy after the remainder of the inventory has been exhausted.

The above and other features of this invention will be fully understood from the following detailed description and the accompanying drawings in which:

FIG. 1 is a front elevation of the presently preferred embodiment of the invention with portions of its mechanism removed for clarity of disclosure;

FIGS. 2 and 3 are sections taken at lines 2—2 and 3—3 of FIG. 1, respectively;

Figure 1:
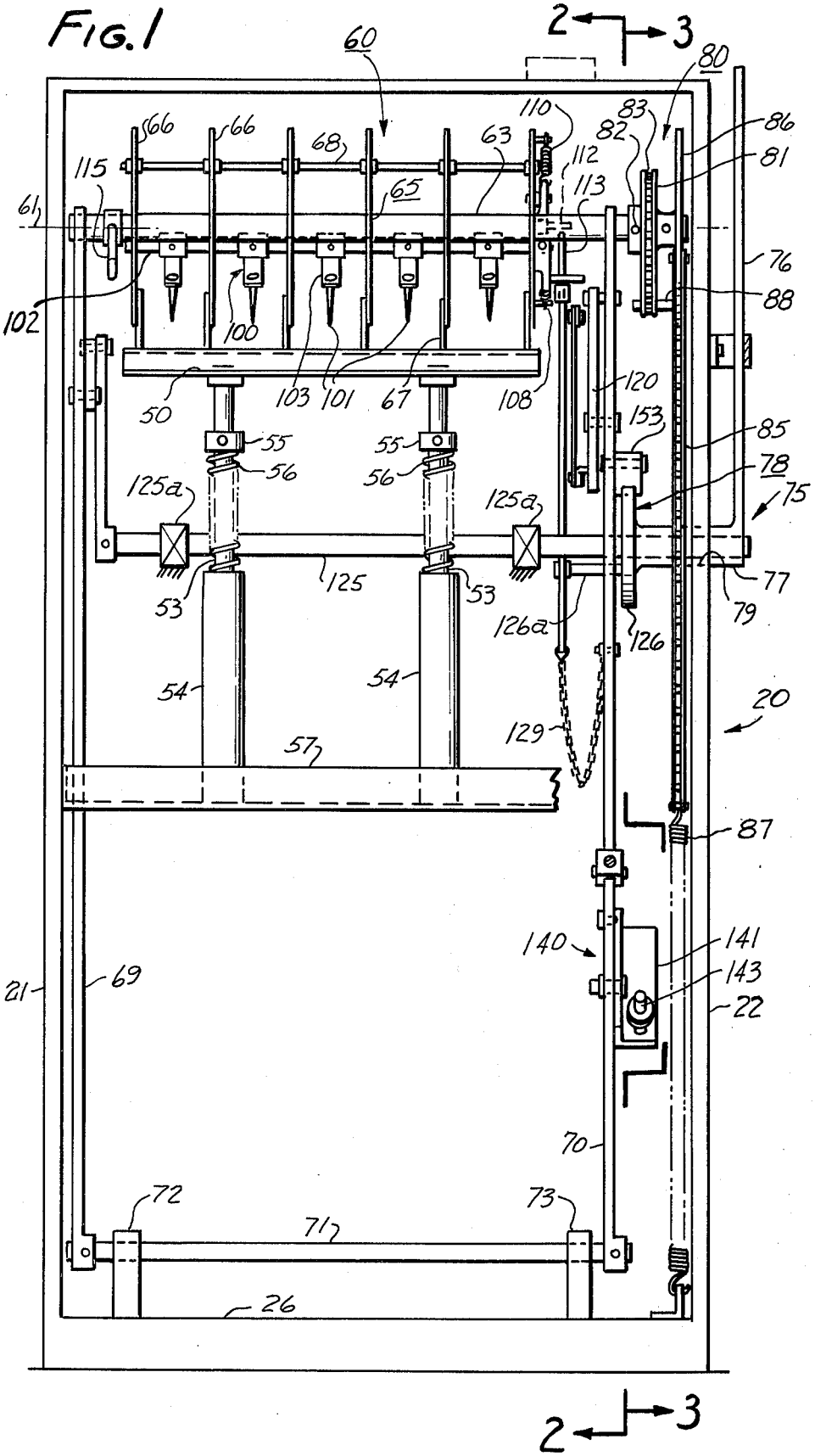
Figure 2:
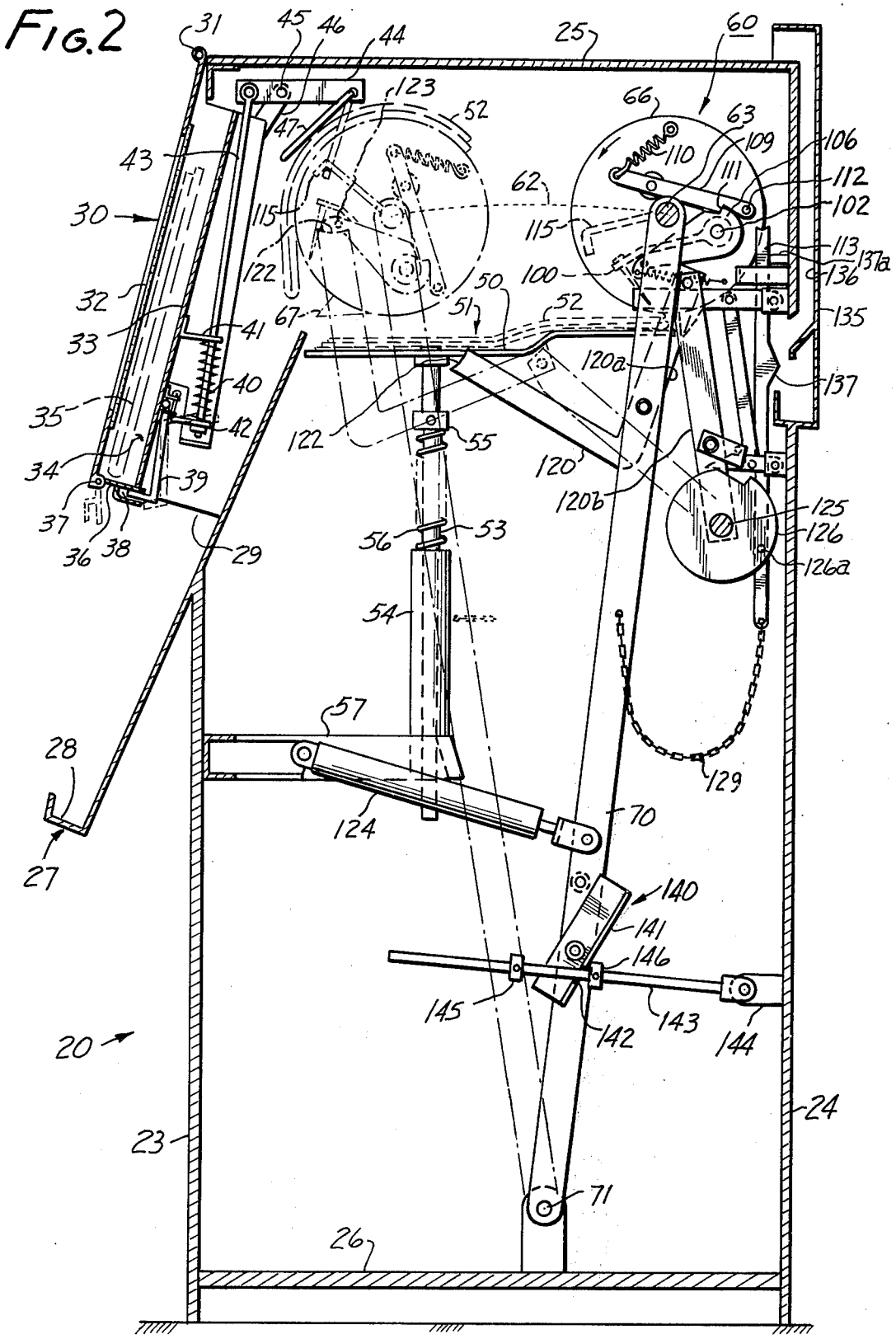

A vending machine 20 (sometimes called a "Device") according to the invention is shown in FIGS. 1 and 2. It has a frame which includes a pair of side plates 21, 22, and as shown in FIG. 2, a front wall 23 and a rear wall 24. A cover 25 extends between the side frames and the two walls. The device is self-supporting. A base plate 26 closes the bottom.

As best shown in FIG. 2, an external shelf 27 is provided to receive an issued article. It has a flange 28 to support the article. The article passes through a slot 29 (sometimes called an "aperture") formed in the front wall. The front wall is partly comprised of a pivoted door 30 hinged to the frame just above the slot. The door is pivoted at hinges 31 so that it can be lifted. When lifted, the device can be re-supplied through the enlarged aperture. The inventory cannot be reached through the small slot which exists when the door is closed.

The door is also provided with a display window 32 and a back rest 33. A display slot 34 is formed between the display window and the back rest to receive and display a "last article" 35. A trap door 36 is hinged by hinge 37 to the bottom edge of pivoted door 30. It includes a latch aperture 38 which can be engaged by a latch arm 39 which latch arm is hinged to the door. This latch arm is spring-loaded to the locked position as shown in FIG. 2 by a bias spring 40 which is in compression between a flange 41 mounted to the door and a lever arm 42 on the latch arm. The bias spring thereby biases the latch arm to the illustrated locked position. A shaft 43 is pivoted to a lever plate 44, the lever plate being mounted by pivot 45 to structure 46 connected to the pivoted door. A grapple 47 swings freely from plate 44 to be engaged by means yet to be described for the purpose of unlatching the trap door at the proper time. It dangles freely unless swung out of the way by an article wrapped on the conveyor as shown in dotted line in FIG. 2. The structure just described in connection with the pivoted door permits the last article of the inventory to be display and remain in the door until it is dispensed after the remaining (other) inventory has already been dispensed by the machine.

A shelf 50 (sometimes called "support means") is provided to receive and support a stack 51 of articles 52 to be dispensed by the device. The shelf is supported by means of a spring-loaded shaft 53 which is telescopically fitted into a sleeve 54. A collar 55 on shaft 53 restrains a compression spring 56 whose constant is related to the expected weight of a stack of articles so that it will tend to keep the top article of the stack adjacent to the mechanism above it, as will presently be described. The spring is opposed by collar 55 and by sleeve 54. The sleeve 54 is mounted to the side plates by cross members 57 (see FIG. 1). There is a plurality of shafts 53 and sleeves 54 to prevent the shelf from cocking and to provide better support.

A stripper means 60 is placed within the vending machine. It has an axis of rotation 61 and is adapted to be moved laterally relative thereto along a path 62 (FIG. 2) that overlays the stack of articles, and is generally parallel to it. The stripper means includes a central shaft 63 coaxial with axis 61.

The stripper means also includes a rotatable conveyor 65 (sometimes called a "rotatable member") which comprises a plurality of discs 66 (sometimes called "circumferential bodies") which are rigidly mounted to shaft 63, and therefore rotate with it. These discs carry stop members 67 which align the edge of an article to be dispensed in the position of FIG. 1. The peripheries of the discs lie on the surface of a theoretical cylinder, and comprise 37 abutment means" or "abutment surfaces" spaced radially from axis 61 upon which the article can be wrapped. The reason for providing this abutment means in the form of the peripheries of a plurality of discs is to make space for various mechanisms between them, and to lighten the weight and expense of the device itself. A circular shape such as a cylinder is the preferred form of abutment surface, but it is obvious that other shapes of surfaces radially spaced from the axis of rotation 61 may be used instead, as may be spaced-apart slices of a cylinder as shown.

The discs are spaced apart by spacers 68 which keep them aligned on shaft 63. Shaft 63 is journaled in a pair of support arms 69, 70 which are pinned to a journal shaft 71 near the bottom of the device. Two journals 72, 73 mounted to the device rotatably support shaft 71. Accordingly, shaft 63 is movable laterally along an arc which is relatively flat because of the relatively large radius from the centers of journals 72 and 73. The resulting movement is a traverse (travel across) of the top of the stack in particular of the face of the article being issued.

Drive means 75 (sometimes called "power means") comprises a handle 76 and a drive shaft 77. The drive shaft is journaled by journal 79 in the side frame of the machine. As can be seen in FIG. 1, the drive shaft drives a transmission means 78 which can drive the stripper means when engaged, as will later be described. Alternatively to the construction shown, the transmission could have been arranged to drive journal shaft 71, but then the lever would have to be too long for the most suitable device. The use of drive shaft 77 where indicated enables a shorter handle to be used.

Figure 3:
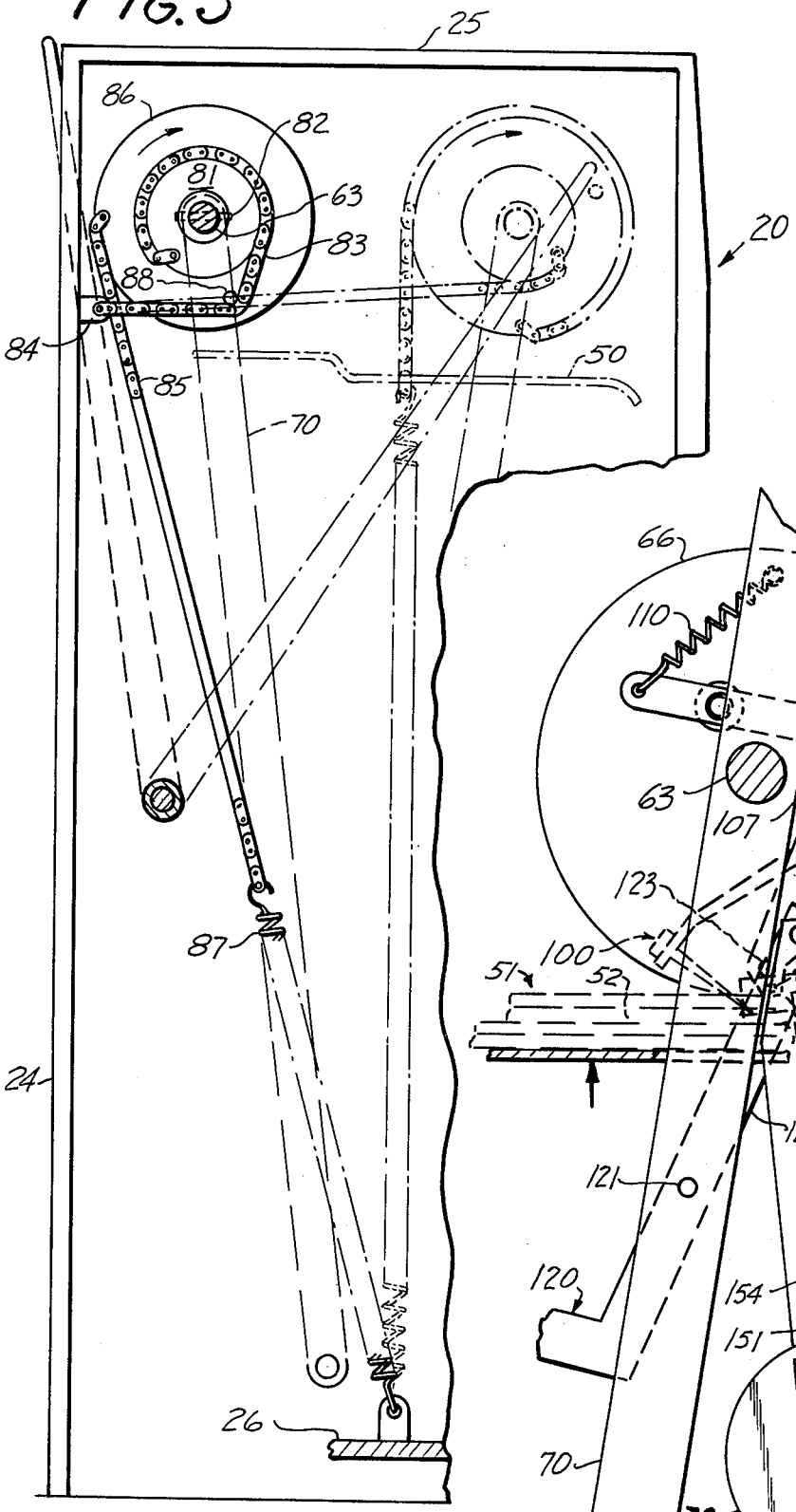

A shaft rotation means 80 is attached to shaft 63. It comprises a sprocket 81 pinned to shaft 63 by pins 82. As shown in FIG. 3, a chain 83 is fixed to the back wall by attachment 84 and brought around the sprocket. This chain will cause the shaft to rotate as it is moved away from the rear wall. A second chain 85 is pinned to a disc 86 that is also rigidly fixed to shaft 63, the other end of the second chain being attached to a return spring 87 which in turn is connected to the frame of the device. This second chain wraps around the outside of disc 86 and will tend to return the system to the left-hand position shown in FIG. 3. Return spring 87 tends to resist motion away from this position. A decelerator pin 88 stubs out from disc 86 and bears against chain 83 to provide a different radial spacing of the chain from shaft 63 for part of the movement. This will vary the rate of the rotation of the shaft as a function of its distance from the rear wall and tend to keep it at a rate which will cause the peripheral surface to rotate at such a velocity as not to pull the article in shear off the stack.

Engagement means 100 is placed between the discs, and provides a plurality of points 101 which are rigidly mounted to an engagement shaft 102 that is journaled in the discs 66 so as to rotate therewith. The engagement means has a retracted position, shown in FIG. 2, and an extended position, best shown in FIG. 4 (sometimes called a "disengaged" and "engaged" condition, respectively). The means includes hardened pointed objects which are mounted to arms 103 that project from shaft 102 and turn with it. In the retracted position, the point lie within the periphery of the discs. In the extended position, they project beyond the periphery of the discs. The pointed objects are mounted to the stripper member through shaft 102.

Figure 4:
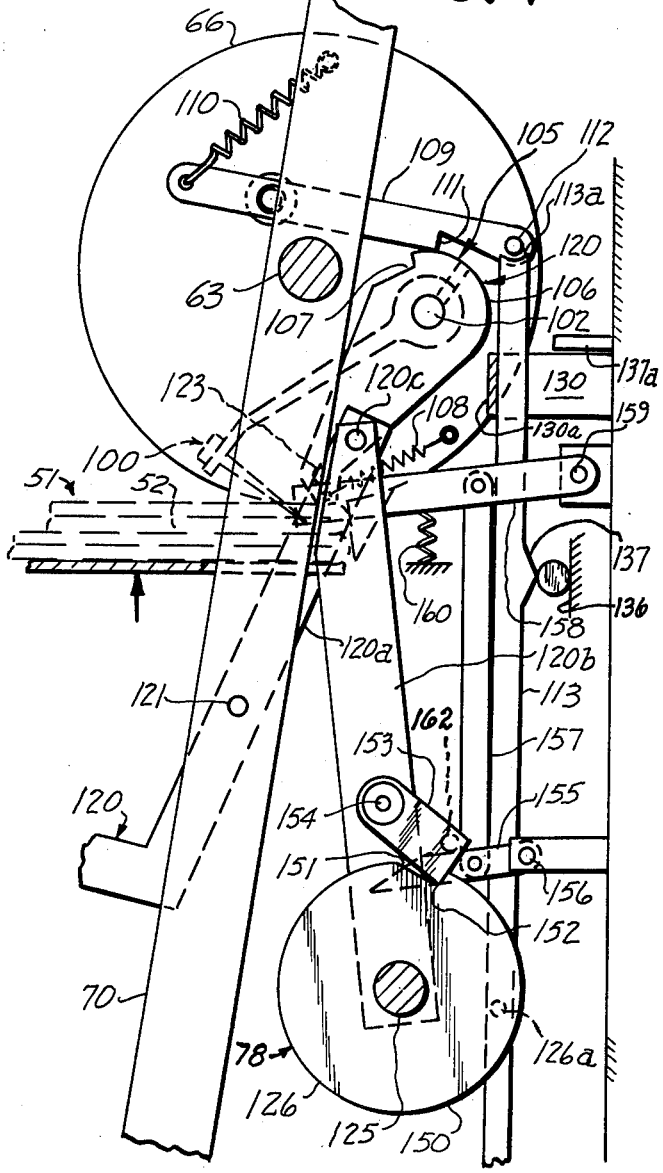
FIG. 4 is an enlarged fragmentary side view of a portion of FIG. 2, showing the device in a driving position.

As best illustrated in FIG. 4, there is also a latch means 105. The latch means includes a latch plate 106 having a notch 107 thereon. The latch plate is rigidly fastened to shaft 102, and turning this plate as a lever moves the engagement means between its two positions. A bias spring 108 biases the latch plate, and also the engagement means, toward the extended position shown in FIG. 4. A latch bar 109 is pivotally mounted to the right-hand disc 66 and is loaded by bias spring 110 toward contact with the latch plate. It has a latch notch 111 and carries a dog 112 which can be engaged and shoved upwardly by an extension means 113 as shown in FIG. 4. The end 113*a* of the extension means is channeled so as to embrace dog 112 when brought against it. Such a channeling is also used on the extension means of the other embodiment of the invention. When the engagement means is retracted as in the right-hand portion of FIG. 2, the latch means latches it in that retracted position, and the bias spring 108 biases the engagement means toward its extended position of FIG. 4, the latch means preventing its going to that position until the latch means is released by the extension means, in which event, under the bias force of spring 108, the points will move beyond the periphery of the discs and engage the topmost article in the stack.

A last-article hook 115 is mounted rigidly to shaft 63, and it will move into the path of the grapple 47 unless the grapple 47 is held away from it by the presence of an article. Such a situation is shown in the left-hand portion of FIG. 2.

A retraction means 120 comprises a rigid link 120a which is pivotally mounted to lever 70 by a pivot pin 121 (FIG. 4) and to a driven lever 120b by a pivot pin 120c. Retraction means has a retraction surface 122 (whch may be channeled) at its end which, as can be seen in the left-hand portion of FIG. 2, is adapted to move upward to strike a dog 123 on the latch plate 106. This will cause the latch plate to rotate and move the engagement means into the retracted position to release and deliver the article over the top of the stripper. The latch means will rotate as the consequence of the bias spring 110 and engage and hold the engagement means retracted until the coin release again releases the extension means and the handle is pulled to issue another article to cause the extension means to engage dog 112.

It will be noted that the retraction of the engagement means is against the spring bias of bias spring 108. The continued rotation of the stripper wheel and the upward motion of retraction surface 112 together exert a compressive force which overcomes the spring bias.

A dash pot 124 is pivotally joined to the frame, and to support arm 70. It retards the return of the system to its rest position. It need not retard the driving stroke toward the left in FIG. 2, because this is opposed by spring 87 and is not likely to be violent.

A driven shaft 125 is journaled by bearings 125a to the frame, and rotates freely inside drive shaft 77. The transmission includes a plate 126 that is rigidly attached to drive shaft 77 and is therefore always rotatable by the handle. Driven lever **120*b* is rigidly connected to driven shaft 125 and forms an extension thereof. The transmission 78 couples the drive shaft and driven shaft under certain conditions to be described. Reciprocating the handle will rotate plate 126 and, because extension means 113 is rotatably pinned thereto by pin 126*a*, will raise and lower the end of the extension means. A slack chain 129 is joined between arm 70 and extension means 113, and has such a length that, when the lever 70 is at its left-hand position in FIG. 2, the chain will pull the lower end of the extension means to the left until it engages stop 130 and moves its upper end toward the rear wall where a magnet 137*a* attracts the magnetizable metallic extension means, or a magnetizable plate attached thereto so as to hold the means 113 against the wall until wedged away from it by a wedge 137 to be described. The stop comprises a flange 130*a* that projects into the path of means 113 as it attempts to pivot around pin 126*a*** and move away from the wall.

A coin release mechanism 135 is fitted to the rear wall of the device and includes a coin chute 136. This is simply one example of a coin release mechanism which is useful for this device. Any other type can be used instead which will cause the required reactions to occur.

Figure 5:
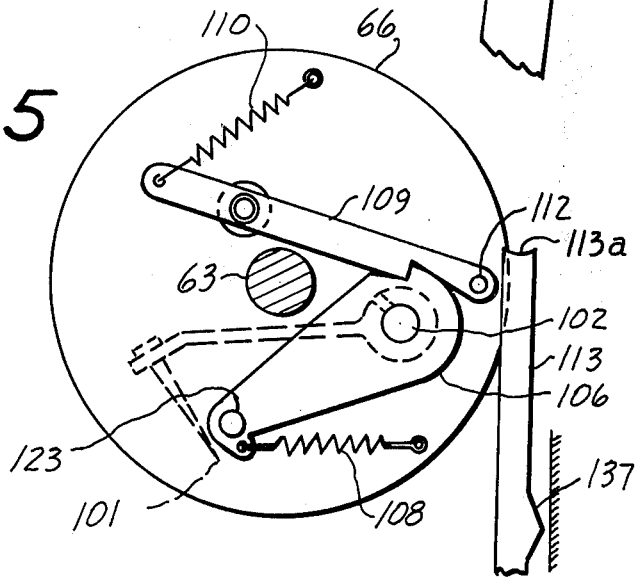
FIG. 5 is an enlarged fragementary view similar to FIG. 4, showing the device in a position where driving is attempted, but in which sufficient or no coins have been provided.

The extension means carries a wedge 137 at its edge, and if, as shown in FIG. 5, there is no coin in the slot, the upper end of the trigger arm can move up and down in a path which will pass by dog 112 without striking it, and will, therefore, not release the latch means. The magnet **137*a* holds the wedge to the right in FIG. 4 until the wedge is forced away from the wall. The engagement means, therefore, remains in its retracted position if there is not coinage presented in a predetermined amount. If, on the other hand proper coinage is present, as shown in FIG. 4, then the coin (or some part of the coin release means) will deflect the extension means to the left, overcoming the magnetic force, so that it does strike dog 112, the latch means will release, and the engagement means will be moved by the bias spring to the extended position, piercing the article to be delivered near its edge, and holding the article to the periphery of the stripper means. The channeled end of the means 113** causes this means to remain against the boss.

Catch means 140 is mounted to arm 70. It comprises a pivoted flange plate 141 with a slit 142 through which a rod 143 extends. This rod is journaled by journal 144 to the rear wall. Two collars 145, 146 are fitted to the rod. As can be seen in FIG. 2, when arm 70 is moved to the left, the flanged plate will rotate to permit this motion. However, if the arm is stopped part way to collar 145 and attempts to move back, the result will be a wedging action between the rod and the sides of the slit which will prevent the arm from moving back. This insures that the device will be operated through a full cycle to deliver an article. Arms 69 and 70 can be returned to "start" only after arm 70 has been pulled so far that the flanged plate strikes collar 145. This contact will turn the flanged plate to change its position so it will let the rod pass freely between the edges of the slit while arm 70 returns to its initial position.

Figure 6:
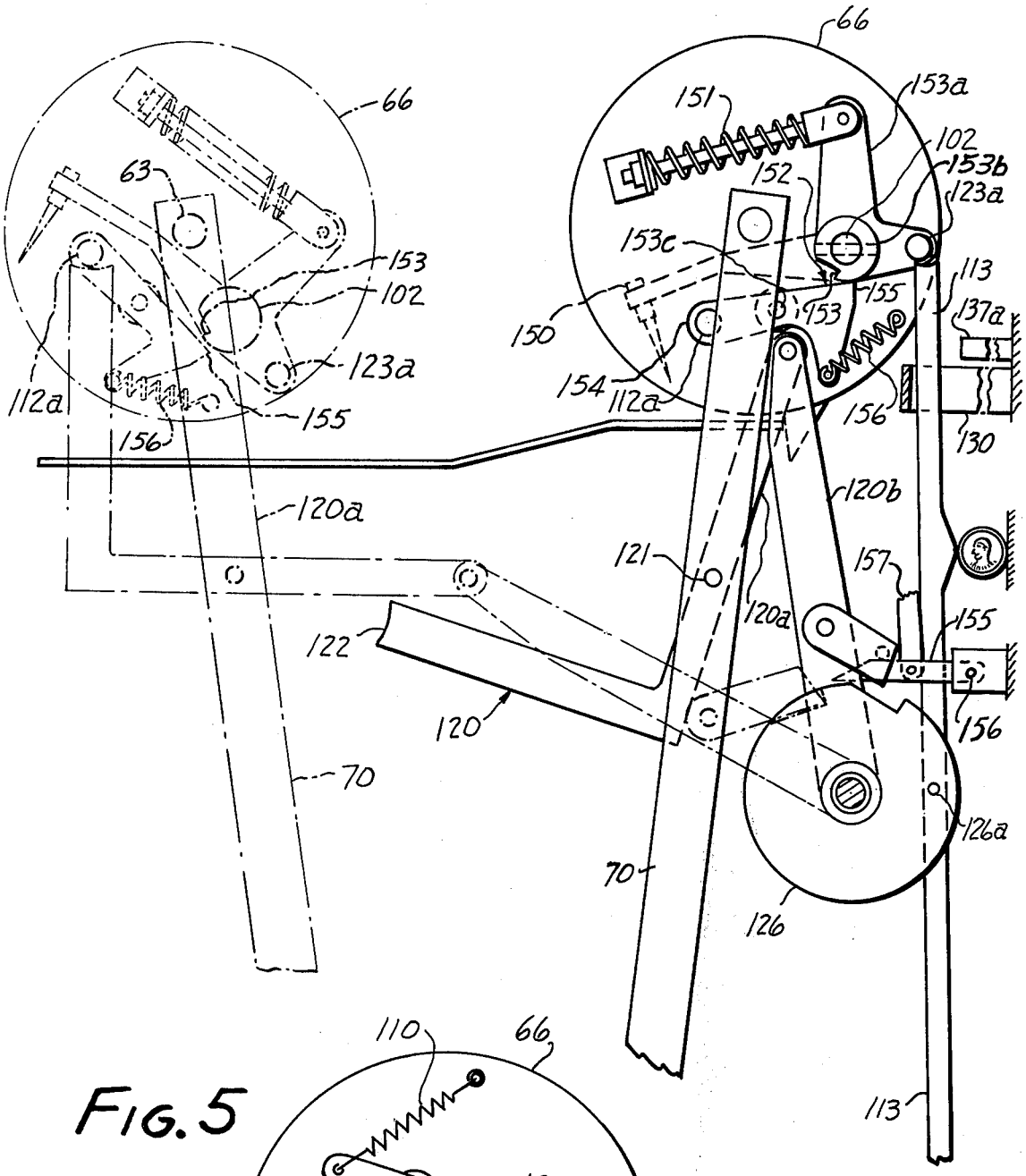
FIG. 6 is a fragmentary side view, partly in cutaway cross section showing an alternate embodiment in two operating positions.

In FIGS. 1–4, the spring bias on the engagement means is such as to cause the engagement means, absent restraint by the latch means, to engage the top article in the inventory, and the engagement means will be released to penetrate the top article by release of the latch means caused by the extension means. FIG. 6 shows a reversal of this arrangement, where the bias is opposite. Only those portions which are essential to an understanding of this reversal will be described herein. Disc 66 is shown in FIG. 6 returned to start and ready for extension of the engagement means. Engagement means 150 is shown pivotally mounted to the same engagement shaft 102. Instead of a tension spring for bias, a compression bias spring 151 is provided, which biases the engagement means toward the retracted position, rather than to the extended position. A latch plate **153*a* is pinned to the engagement shaft 102 by pin 153*b*. It carries a latch notch 153. Latch means includes a latch bar 154 pivotally mounted to disc 66 by pin 153*c*, and having a latch face 155. A tension spring 156 urges the latch bar toward its latched position. In this device, the latched position cannot occur until after a coin has been inserted. A dog 112*a* is fixed to the latch bar, and a dog 123*a* is fixed to the latch plate. As can be seen in the left-hand portion of FIG. 6, the retraction means has contacted dog 112*a* and released the latch means, and the engagement means has been withdrawn by the bias spring. It will remain withdrawn until forced out by the extension means. It can be forced out by contact between the extension means 113 and the dog 123***a* on the latch plate, when there has been sufficient upward movement of the extension means (proper coinage having been supplied) beyond that position shown at the right-hand side of FIG. 6 to cause the engagement means to extend beyond the periphery of the disc. Then, the point having been forced into the top article, the latch means will latch the engagement means in the extended position. This is, therefore, a reversal of the operation of the device of FIG. 1, all other significant features of the two constructions being alike.

Figure 7:
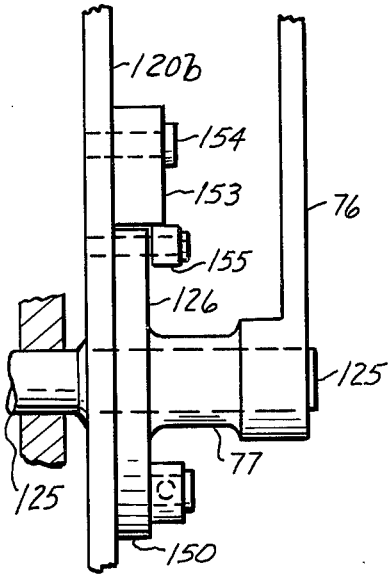
FIG. 7 is an enlarged elevation of a portion of FIG. 1.

The transmission means 78 is best shown in FIGS. 1, 4 and 7. In FIG. 4, certain parts have been omitted for clarity of presentation, and it is suggested that this figure be referred to at this point. The transmission, as has previously been stated, includes plate 126 which is directly attached to drive shaft 77 so as to rotate with it at all times. Plate 126 includes a periphery 150 which is circular except for a drive notch 151 having a drive wall 152. A pawl 153 is pivotally mounted by pivot 154 to driven lever 120*b*. Driven shaft 125 is loosely journaled in drive shaft 77 and is rotatably free therefrom, except when the two are coupled by the transmission. The pawl is adapted to rest against the periphery and fall into the drive notch if released to do so.

A retainer 155 (see FIGS. 5 and 6) is pivotally mounted to journal 156 in the rear wall of the device. It is joined by a connecting rod 157 that is pivotally mounted to the retainer and to a follower bar 158 that is mounted to the back wall by a journal 159. The follower bar 158 is biased upwardly in FIG. 4 by a bias spring 160, and the extension means is held to the right in FIG. 4 by the magnet until separated from it by the wedge's reaction with the coin release means. It will now be seen that the tendency of the transmission is to be in a decoupled (dis-engaged) condition unless the follower bar is pressed downwardly by contact with dog 123 on the latch plate. When the latch means is released, as shown in FIG. 4, the engagement means will move counterclockwise, and dog 123 will strike the top of the follower bar which in turn will press the connecting rod and the retainer downwardly to release the pawl to fall into the drive notch, and couple the drive shaft to the driven shaft 125 through driven lever 120*b*. A stub 162 projects laterally from the pawl to rest against the top of the retainer so the retainer will control the elevation of the pawl.

The device is shown in FIG. 4 just starting to drive the driven lever 120*b*. There will have been previous counterclockwise rotation of plate 126 in order that there will have been upward movement of the extension means sufficient to release the latch means and engagement means before the drive wall of the drive notch passes beyond the point at which the pawl will be received by it for driving, assuming that proper coinage was presented. This "slack" enables the coin release means to be sensed before the transmission is engaged to driven lever 120*b* (or, more generically, to driven shaft 125 through this lever). In the indicated position in FIG. 4, further movement of the handle will drive the driven shaft and driven lever, and with it the stripper means, to operate as described. The driven lever 120*b* and link 120*a* are duplicated on the left-hand side of the device in FIG. 1, the duplicate driven lever being rigidly fixed to the driven shaft. The retraction means need be provided on only one side.

Had the follower bar not been depressed as a consequence of the release of the engagement means in response to proper coinage, then the smooth periphery 150 of the disc would have simply rotated beneath the raised pawl and driving would not have occurred. Therefore, the handle is completely loose from the issuing mechanism unless coupled to it by the transmission.

The foregoing arrangement is one in which the coin actuation controls the extension means, which obviously can be done even if there were a direct drive between the drive shaft 77 and driven lever 120*b*. It is also possible directly to couple driven shaft 125 and drive shaft 77, without using a transmission that has a de-coupled condition. It is good practice to accomplish this by utilizing the transmission 78, as shown, but without the connecting rod, follower bar, and retainer. This is for the reason that it is desirable to have the said initial slack movement of the extension means so as to extend the engagement means prior to appreciable lateral movement of the stripper means, and the notch and pawl arrangement is a good way of doing this. This enables the article to be engaged before the stripper means starts to rotate. Alternatively, a direct drive may be provided without this slack by modifications which will be apparent to a person skilled in the art. Accordingly, there has been shown a means for controlling the device so as to be responsive to coin means by acting upon the extension means and also by acting upon a transmission through the extension means.

Figure 8:
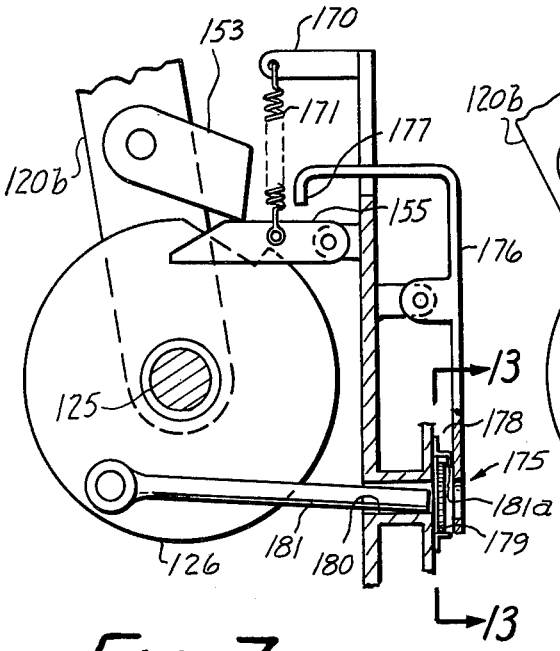
FIGS. 8, 9 and 10 show modifications of transmissions useful with this invention.
Figure 9:
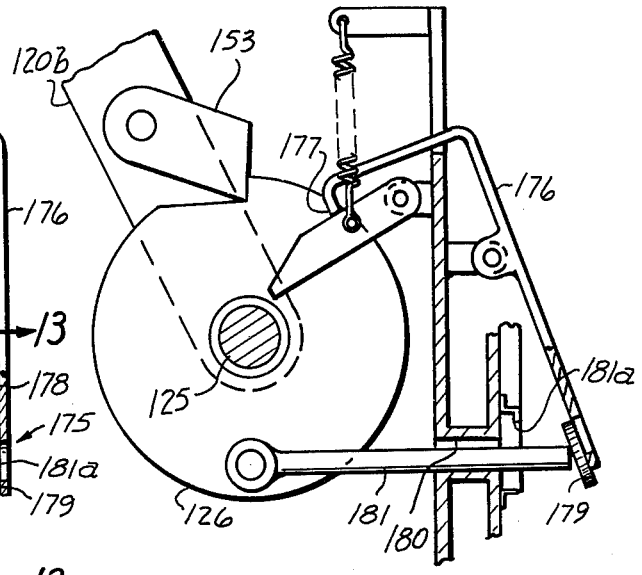
Figure 10:
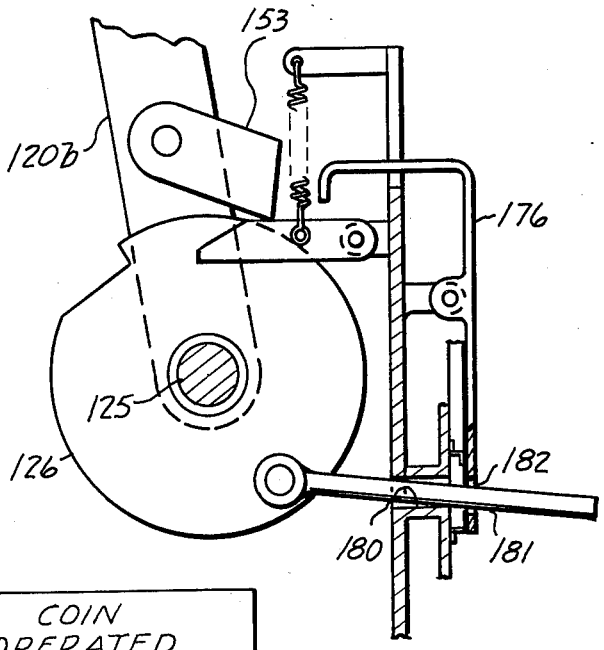

FIGS. 8–10 indicate that it is also possible to control the device entirely at the transmission. For this situation, the transmission has been altered so that, instead of the connecting rod 157, there is provided a spring anchor 170 holding one end of a spring 171 which urges retainer 155 toward its upper position to lift the pawl away from the disc. Coin release means 175 includes a pivoted arm 176 with an overhang 177 which can move to strike the retainer and move it down to the position shown in FIG. 9. A coin slot 178 receives a coin 179 and stands aligned with an aperture 180 through which a push-rod 181 extends which is pivotally joined to the disc. When proper coinage is placed in the slot and stands in the path of the push-rod, rotation of the plate will cause the rod to press against the coin, and spread apart a flexible wall 181*a* of the coin slot to push the coin out of it. Still bearing against the coin, it will pivot the arm 176 so as to press down the retainer and permit the pawl to fall and engage the disc and the device will operate to issue an article. This is shown in FIG. 9. If, however, no coin is present as in FIG. 10, then the push-rod simply moves through aperture 180 and through a hole 182 in the pivoted arm 176 and will not cause actuation.

Therefore, FIG. 9 shows a condition in which the transmission is coupled, and FIG. 10 shows a condition where the transmission is decoupled. It is immaterial whether the engagement means in the stripper member is extended or retracted, so that the device of either FIG. 1 or of FIG. 6 can be used. In the device of FIG. 1, the engagement means will be biased toward the extended position, the movement of the extension means being such as always to be on a path to engage dog 112 and thereby release the engagement means when the handle is pulled with the transmission engaged. FIG. 1 as illustrated is the presently preferred embodiment of the invention. However, when the device is to be controlled only at the transmission, the device of FIG. 6 is to be preferred.

Figure 11:
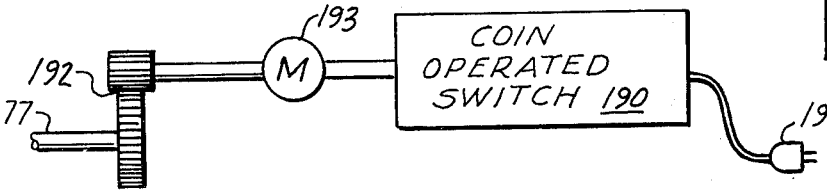
FIG. 11 is a schematic showing of yet another embodiment of this invention.

FIG. 11 schematically illustrates that the transmission may always be engaged, and that a direct drive can be provided between the drive shaft and the driven shaft 125, (or driven lever 120*b*) and that a coin actuated switch 190 or some other means can be interposed between a source of power 191 and the output gear 192 of power means such as a motor 193, which will drive the drive shaft 77 or directly drive the driver shaft 125.

Also, if desired, the support arm may be directly pulled by the purchaser, instead of a handle. This involves the disadvantage of a longer lever, or of slotting the framework, but it can be done, and sometimes may be. This may be accomplished by extending one of arms 69 or 70 through a side or through the top of the device. If this is done, then the coin actuated means will be used directly to control the engagement means, so as to extend them when proper coinage is presented, and pulling the arm will then deliver a copy. The lever may be freely pulled, and no copy will be delivered unless the engagement means is extended.

Alternatively, coin release means may lock the driven shaft 125 unless there is proper coinage, and then there need be no control over the engagement means. Any suitable coin-operated lock may be used to prevent or alternatively to permit rotation of shaft 125.

It is believed that the operation of the device will be evident from the foregoing. It may generally be stated that the article engagement means, which preferably comprises means for piercing an article to be dispensed (although other article engagement techniques may be used instead) has an extended and a retracted position (or engaged and disengaged), respectively inside of the outside of the stripper means. Retraction means comprising surface 122 on the end of link 120*a* is adapted to cause the article engagement means to move to its retracted position at the end of the delivery stroke, i.e., as shown at the left-hand position of FIG. 2. This surface 122 is at the end of a "grasshopper" linkage, which interlinks driven lever 120*b* and support arm 70, and either engages dog 123 to retract the engagement means against their bias means, or in the embodiment of FIG. 6, to engage dog 112*a* to release the latch and permit the engagement means to be retracted by the bias force.

An extension means, such as extension means 113 has an active position and a passive position relative to the engagement means when control over the device is exerted by means of controlling the extension or retraction of the engagement means. When such control is not provided, then the extension means will have only an active position and coinage control will be exerted elsewhere. The extension means will cause the engagement means to assume its extended position. In FIG. 2, the extension is caused by unlatching the latch means and permitting the bias means to extend the engagement means. In FIG. 6, the extension is caused by forcing the engagement means to the extended position against its bias means, and latching it. Coin control means can be provided which is determinative of the active or passive position of the extension means, or of the coupled or decoupled condition of the transmission, or of the availability or lack of availability of power to the driven shaft.

The transmission means has a coupled and a uncoupled sometimes called ("de-coupled") condition, the coupled condition being responsive to the receipt of proper coins when the transmission means is controlled directly by the coin control means or indirectly through the engagement means.

In the usage of the device, the pivoted door is unlocked and opened, and the desired inventory is placed atop the shelf, which will be lowered by the weight of the inventory so that the top article will just be pressed against the bottom of the stripper member and so that the rear edge of the stack will abut the stop members 67. If a last article is used, it is placed in its slot and the trap door latched. The door is then closed and locked. In the device of FIGS. 1–5, if there is no coin present, the handle can be moved back and forth, and the pawl will not engage with the notch in the transmission so that there will be no internal effect on the stripper member. The extension means will move up and down to the right of dog 112 without striking it.

Had a transmission been provided which would always be coupled, then the stripper member would have been moved back and forth because arm 70 and lever 120*b* would be driven. The movement of the stripper member would not cause delivery of an article unless the engagement means is extended, except in case a last article is provided in the door. It will, however deliver the last article unless an article covers hook 115 when it passes the grapple. The last article means is therefore not provided in this device unless there is a control over the transmission, because the grapple would be engaged at any time the stripper member is at the left-hand position in FIG. 2 unless there is an article engaged to the periphery of the stripper member and covering hook 115. The same situation would pertain for the embodiment of FIG. 11 where the control is over the source of power only, and also when the support arm is directly driven.

Returning now to FIGS. 1–5, should there be no coinage present in the predetermined amount, then the extension means will simply move up and down on its right-hand path with the magnet holding the extension means in this path. However, should there be a coin present, the coin directly, or some other means actuated by the coin release means as a consequence of the coinage, will deflect the wedge face on the extension means to the left (FIG. 4) as means 113 moves upwardly, and the end of the extension means will strike dog 112, which it will cradle in its channeled end, and push to unlatched the latch means. The engagement means will then be extended by the bias means to engage the article, and boss 123 will cause the pawl to drop and couple the transmission. Further driving of the device by continuing to pull the handle will cause the top article to be peeled off the stack and wrapped around the stripper member on the abutment surface as the stripper member rolls along path 62 at a rate determined by the rotation means. The article goes up and over the top of the stripper member, which reaches the end of its travel as shown at the left in FIG. 2. At this time the retraction means will cause the engagement means to be withdrawn to their retracted position, by engaging dog 123 and pressing on the latch plate. This releases the article, which will fall through the slot to the purchaser. Releasing the handle will cause the device to return to its start position.

In the reversal of parts situation in FIG. 6, the operation is the same except that, when the coin release commands it, the extension means will itself force the engagement means to its extended position against the bias means by pressing against dog 123*a* on the latch plate connected to shaft 102, and the engagement means will be latched by the latch in the extended position. When the article is to be released, the latch is released by the retraction means at the end of the stroke, which strikes dog 112*a*.

When the device is solely under control of the transmission, then the arrangement of FIGS. 8, 9 and 10, or some other functionally similar means, will be provided for the coupling at the transmission of the pawl and the drive shaft so as to deliver the article. The operation of this transmission has already been described.

When the last article is to be dispensed, and the device is actuated, the engagement means obviously will not pick up any article from the stack. When the stripper means reaches the end of its path, the grapple is engaged by hook 115 so as to release the latch on the trap door. The trap door opens and lets the last article fall out. Thereafter, a prospective purchaser will be able to tell that there is no article for purchase and will not put in any coins, because the device will obviously be empty.

It is evident that means other than lever-type arms can be used to support the stripper means. For example, shaft 63 could be mounted to a pair of tracks, and sprocket 81 could engage a rack, the track and rack being parallel to the top of the stack of articles. Shaft 63 would be rotated by reaction of the rack and sprocket as shaft 63 is moved along the track by some means such as a handle.

The stripper means is distinguished from other known devices by its rotation as it moves along a stack of articles, in adjacency there to, with the article to be delivered engaged to its periphery so as to peel, rather than to slide, the end article off of the stack. Of course some slight shear movement might result as a consequence of the relative dimensions involved, but the primary movement is that of peeling rather than pulling. For example, this device is to be distinguished from a wheel whose axis is fixed relative to the stack, and which would engage and pull an article from the stack. Such delivery would be that of a shearing separation, rather than that of a peeling or stripping separation.

Because there is no shear (or "sliding") movement between adjacent articles of the inventory, many problems of the prior art are avoided, such as wrinkling and tearing of the articles or adherence of them one to another so that multiple copies are delivered. This device completely avoids these problems. The phrase "traversing the exposed face of the article to be issued" as used herein means moving the axis of the rotatable member of the stripper means so that the rotatable member does not drag the article in shear away from the stack. The "exposed face" of the article is the flat surface exposed to the stripper means. The axis is moved far enough that the article will mainly be lifted from the stack, and will be able to slide off, over the top of the stripper member.

Among other advantages is that there is no access afforded to the purchaser to any part of the inventory. Further, engagement to the article is not damaging or destructive in any way (pin holes being an expected feature in printed articles).

The device is subject to numerous techniques of control, such as control over the transmission of applied power, control over the source of power, and control of engagement of non-engagement to an article.

The device may be made of rugged parts, which are relatively inexpensive, and is proof against misuse by a vandal.

This invention is not to be limited by the embodiments shown in the drawings and described in the description, which are given by way of example and not of limitation, but only in accordance with the scope of the appended claims.

I claim:

1. In a vending machine for issuing a single article from a stack of such articles, stripper means for stripping an end article from said stack, the article to be issued having an exposed face, and the stripper means comprising: a rotatable member having an axis of rotation and a direction of rotation when the article is being removed by it from the stack, an abutment surface on the rotatable member radially spaced from said axis, means for rotating the rotatable member and for simultaneously moving it laterally in a path across the stack, whereby to traverse the exposed face from adjacent one edge thereof, engagement means pivotally mounted to the rotatable member, said engagement means comprising an elongated pointed article-engaging element having a point and a piercing axis, and and extended engaged and a retracted disengaged condition in which the point is respectively radially outside of and inside of the abutment surface, the piercing axis of the engagement means making an acute angle with the exposed face of the article when extended and engaged thereto, with the piercing axis facing in the direction of rotation, whereby the article-engaging elements can be engaged to the article near said edge in the engaged condition, and while engaged to an article, the rotatable member may be simultaneously rotated and moved laterally across the face of the stack so as to wrap the article against the abutment surface with the article held to the rotatable member as a consequence of the said angularity of the said piercing axis, and strip it from the stack, and whereby the engagement means may be placed in the disengaged condition to permit said article to be released and delivered over the top of the rotatable member, and the rotatable member can be returned to the initial position to repeat the said sequence, and stop means fixed to the rotatable member, projecting beyond its abutment surface, to be abutted by the article to be stripped so as to align the same at the time the article-engaging elements pierce the article.

2. Apparatus according to claim 1 in which extension means is provided to move the said elements to the extended engaged position, and in which retraction means is provided to move the said elements to the retracted disengaged position.

3. Apparatus according to claim 2 in which spring bias means is provided to force the said engagement means toward one of said positions, and in which latch means is provided to hold them in the position opposed by the said bias means, and in which one of said extension means or retraction means is effective to force the engagement means to said opposed position where the latch means holds it, and in which the other is effective to release the latch means to enable the bias means to move the engagement means to the other position.

4. Apparatus according to claim 3 in which said bias means biases the engagement means toward its disengaged condition.

5. Apparatus according to claim 3 in which said bias means biases the engagement means toward its engaged condition.

6. Apparatus according to claim 3 in which the engagement means comprises a plurality of said article engaging elements.

7. Apparatus according to claim 3 in which the stripper member includes a central shaft, in which the abutment surface is located on a circumferential body mounted to said shaft for rotation therewith, and in which the engagement means comprises a plurality of said article engaging elements pivotally mounted to said circumferential body in such manner as to be extensible beyond and retractible within said abutment surface.

8. Apparatus according to claim 1 in which coin-controlled means prevents the engagement means from assuming the engaged condition except upon the presentation of predetermined coinage.

9. Apparatus according to claim 1 in which coin-controlled means prevents the said stripping movement of the stripper means except upon the presentation of predetermined coinage.

10. Apparatus according to claim 9 in which coin-controlled means prevents the engagement means from assuming the engaging condition except upon the presentation of predetermined coinage.

11. A vending device for issuing a single flexible article from a stack of such articles, the article to be issued having an exposed face, the vending device comprising: a frame excluding persons from its interior and thereby from an inventory of articles therein and having an aperture through which an article is issued; a support means supporting the stack; a door in said frame giving access to the support; stripper means for stripping an end article from said stack and comprising a rotatable member having an axis of rotation and a direction of rotation when the article is being removed by it from the stack, an abutment surface radially spaced from said axis, means for rotating the rotatable member and for moving it laterally in a path across the stack toward the slot, whereby to traverse the exposed face, engagement means comprising elongated pointed article-engaging elements having a point, a piercing axis, and an engaged and a disengaged condition in which the point is respectively radially outside of and inside of the abutment surface, the piercing axis of the engagement means making an acute angle with the exposed face of the article when extended and engaged thereto, with the piercing axis facing in the direction of rotation, whereby with the article-engaging elements in the engaged condition and engaged to an article, the rotatable member may be simultaneously rotated and moved laterally across the face of the stack so as to wrap the article against the abutment surface with the article held to the rotatable member as a consequence of the said angularity of the said piercing axis, and strip it from the stack, and whereby the engagement means may be placed in the disengaged condition to permit said article to be released and delivered over the top of the rotatable member, and the rotatable member can be returned to the initial position to repeat the sequence, and stop means fixed to the rotatable member, projecting beyond its abutment surface, to be abutted by the article to be stripped so as to align the same at the time the article-engaging elements pierce the article.

12. A vending machine according to claim 11 in which coin-controlled means prevents the engagement means from assuming the engaging condition except upon the presentation of predetermined coinage.

13. A vending device according to claim 11 in which power means is provided as a source of force to move the stripper member, and in which coin-controlled means is interposed between the stripper member and said power means to prevent movement of said stripper member except upon the presentation of predetermined coinage.

14. A vending device according to claim 13 in which said coin-controlled means is a coin-actuated power switch.

15. A vending device according to claim 13 in which said coin-controlled means is a lock which prevents said movement.

16. A vending device according to claim 13 in which said coin-controlled means is a transmission having a coupled and a de-coupled condition.

17. A vending device according to claim 16 in which said power means is a handle.

18. A vending machine according to claim 11 in which extension means is provided to move the said article-engaging elements to the extended position, and in which retraction means is provided to move the said article-engaging elements to the retracted position.

19. A vending machine according to claim 18 in which spring bias means is provided to force the said engagement means toward one of said positions, and in which latch means is provided to hold them in the position opposed by the said bias means, and in which one of said extension means or retraction means is effective to force the engagement means to said opposed position where the latch means holds it, and in which the other is effective to release the latch means to enable the bias means to move the engagement means to the other position.

20. A vending machine according to claim 19 in which said bias means biases engagement means toward its engaged condition.

21. A vending machine according to claim 19 in which the engagement means comprises a plurality of said article-engaging elements pivotally mounted to said stripper member.

22. A vending machine according to claim 19 in which the stripper member includes a central shaft, in which the abutment surface is located on a circumferential body mounted to said shaft for rotation therewith, and in which the engagement means comprises a plurality of said article-engaging elements pivotally mounted to said circumferential body in such manner as to be extensible beyond and retractible within said abutment surface.

23. A vending machine according to claim 19 in which said bias means biases the engagement means toward its disengaged condition.

24. A vending device for issuing a single flexible article from a stack of such articles, the article to be issued having an exposed face, and the vending device comprising: a frame excluding persons from its interior and thereby from an inventory of articles therein, and having an aperture through which an article is issued; a support means supporting the stack; a door in said frame giving access to the support; stripper means for stripping an end article from said stack and comprising a rotatable member with an axis of rotation and having a peripheral abutment surface radially spaced from the axis of rotation, article engaging means pivotally mounted to the rotatable member so as to be extensible beyond and retractible within the abutment surface to an extended position and a retracted position, respectively, bias means forcing the engagement means toward one of said positions, and releasable latch means for holding the engagement means in the position opposed by the bias means; a pivotally mounted support arm mounting the rotatable member for rotation around its axis and for simultaneous movement lateral to said axis and generally adjacent to and across the said stack, whereby to traverse the exposed face; extension means to move the engagement means to the extended position; retraction means to move the said engagement means to the retracted position, one of said extension means or retraction means being effective to force the engagement means to said opposed position, and the other being effective to release the latch means to enable the bias means to move the engagement means to the other position; power means for moving the support arm; and means for rotating the stripper means as the support arm is moved.

25. A vending device according to claim 24 in which the extension means has a passive condition in which it has no effect on the engagement means, and an active condition where it causes extension thereof, and coin-release means to maintain the extension means in the passive condition in the absence of coinage of predetermined amount and to permit it to assume its active condition in the presence of coinage of the predetermined amount.

26. A vending device according to claim 24 in which the door has a window, a slot to hold a "last article", and a trap door to hold the last article in the slot, and grapple means to open said trap door when the stripper means moves into adjacency with it and does not carry an article to be issued.

27. A vending device according to claim 24 in which stop means is fixed to the rotatable member, projecting beyond its abutment surface, to be abutted by the article to be stripped so as to align the same at the time the elements pierce the article.

28. A vending machine according to claim 24 in which said bias means is resilient, and biases the engagement means toward its engaged condition.

29. A vending machine according to claim 28 in which said article-engaging means comprises a plurality of pointed elements.

30. A vending device according to claim 24 in which the power means is a handle, and in which a transmission having a coupled and a de-coupled condition is interposed between the handle and the support arm.

31. A vending device according to claim 30 in which coin-actuated means is provided to de-couple the transmission in the absence of predetermined coinage, and to couple the same in the presence of sufficient coinage.

32. A vending device according to claim 30 in which a driven link and link are interposed between the support arm and the transmission, the handle driving the support arm through said driven link and link.

33. A vending machine according to claim 32 in which the retraction means is formed on said link.

34. A vending machine according to claim 30 in which a driven link and a link are interposed between the handle and the support arm.

35. A vending machine according to claim 34 in which the retraction means is formed on said link.

36. A vending device according to claim 24 in which the stripper means has a direction of rotation when the article is being removed by it from the stack, in which the article engaging means comprise elongated pointed article-engaging elements having a piercing axis, the piercing axis of the engaging means making an acute angle with the exposed face when extended and engaged thereto, with the piercing axis facing in the direction of rotation.

37. A vending device according to claim 36 in which stop means is fixed to the rotatable member, projecting beyond its abutment surface, to be abutted by the article to be stripped so as to align the same at the time the elements pierce the article.

38. A vending device according to claim 36 in which said bias means is resilient, and biases the engagement means toward its engaged condition.

39. A vending device according to claim 36 in which the power means is a handle, and in which a transmission having a coupled and a de-coupled condition is interposed between the handle and the support arm.

40. A vending device according to claim 39 in which coin-actuated means is provided to de-couple the transmission in the absence of predetermined coinage, and to couple the same in the presence of sufficient coinage.

41. A vending device according to claim 39 in which a driven link and link are interposed between the support arm and the transmission, the handle driving the support arm through said driven link and link.

42. A vending device according to claim 39 in which a driven link and a link are interposed between the handle and the support arm.

43. In a vending machine for issuing a single article from a stack of such articles, stripper means for stripping an end article from said stack, the article to be issued having an exposed face, and the stripper means comprising: a rotatable member having an axis of rotation and a direction of rotation when the article is being removed by it from the stack, an abutment surface on the rotatable member radially spaced from said axis, means for rotating the rotatable member and for simultaneously moving it laterally in a path across the stack, whereby to traverse the exposed face from adjacent one edge thereof, engagement means pivotally mounted to the rotatable member, said engagement means comprising an elongated pointed article-engaging element having a point and a piercing axis, and an extended engaged and a retracted disengaged condition in which the point is respectively radially outside of and inside of the abutment surface, the piercing axis of the engagement means making an acute angle with the exposed face of the article when extended and engaged thereto, with the piercing axis facing in the direction of rotation, whereby the article-engaging elements can be engaged to the article near said edge in the engaged condition, and while engaged to an article, the rotatable member may be simultaneously rotated and moved laterally across the face of the stack so as to wrap the article against the abutment surface with the article held to the rotatable member as a consequence of the said angularity of the said piercing axis, and strip it from the stack, and whereby the engagement means may be placed in the disengaged condition to permit said article to be released and delivered over the top of the rotatable member, and the rotatable member can be returned to the initial position to repeat the said sequence, extension means to move the said elements to the extended engaged position, retraction means to move the said elements to the retracted disengaged position, and spring bias means to force the said engagement means toward one of said positions, latch means to hold the engagement means in the position opposed by the said bias means, one of said extension means or retraction means being effective to force the engagement means to said opposed position where the latch means holds it, the other being effective to release the latch means to enable the bias means to move the engagement means to the other position, the said stripper member further including a central shaft, a plurality of axially spaced-apart discs rigidly mounted to said shaft, the engagement means comprising a plurality of said pivoted, pointed article-engaging elements located between the discs, and a rotatable latch plate rigidly connected to said pointed article-engaging elements so as to move the pointed members to the extended position beyond the abutment surface which lies on the periphery of the discs, and to the retracted position which lies radially within the same, and a latch bar mounted to one of the discs, said latch bar and latch plate comprising said latch means.

44. A vending device for issuing a single flexible article from a stack of such articles, the article to be issued having an exposed face, the vending device comprising: a frame excluding persons from its interior and thereby from an inventory of articles therein and having an aperture through which an article is issued; a support means supporting the stack; a door in said frame giving acess to the support; stripper means for stripping an end article from said stack and comprising a rotatable member having an axis of rotation and a direction of rotation when the article is being removed by it from the stack, an abutment surface radially spaced from said axis, means for rotating the rotatable member and for moving it laterally in a path across the stack toward the slot, whereby to traverse the exposed face, engagement means comprising elongated pointed article-engaging elements having a point, a piercing axis, and an engaged and a disengaged condition in which the point is respectively radially outside of and inside of the abutment surface, the piercing axis of the engagement means making an acute angle with the exposed face of the article when extended and engaged thereto, with the piercing axis facing in the direction of rotation, whereby with the article-engaging elements in the engaged condition and engaged to an article, the rotatable member may be simultaneously rotated and moved laterally across the face of the stack so as to wrap the article against the abutment surface with the article held to the rotatable member as a consequence of the said angularity of the said piercing axis, and strip it from the stack, and whereby the engagement means may be placed in the disengaged condition to permit said article to be released and delivered over the top of the rotatable member, and the rotatable member can be returned to the initial position to repeat the sequence, extension means to move the said article-engaging elements to the extended position, retraction means to move the said article-engaging elements to the retracted position, and spring bias means to force the said engagement means toward one of said positions, latch means to hold the said engagement means in the position opposed by the said bias means, one of said extension means or retraction means being effective to force the engagement means to said opposed position where the latch means holds it, and the other being effective to release the latch means to enable the bias means to move the engagement means to the other position, the stripper member including a central shaft, a plurality of axially spaced-apart discs rigidly mounted to said shaft, the engagement means comprising a plurality of said pivoted, pointed article-engaging elements located between the discs, a rotatable latch plate rigidly connected to said pointed article-engaging elements so as to move the pointed members to the extended position beyond the abutment surface which lies on the periphery of the discs, and to the retracted position which lies radially within the same, and a latch bar mounted to one of the discs, said latch bar and latch plate comprising said latch means.

* * * * *